US007624673B2

(12) United States Patent
Zanetti

(10) Patent No.: US 7,624,673 B2
(45) Date of Patent: Dec. 1, 2009

(54) SINGLE-DOSE PLASTIC CAPSULE FOR POWDERED COFFEE AND THE LIKE

(75) Inventor: Martino Zanetti, Villorba (IT)

(73) Assignee: Hausbrandt Trieste 1892 SPA, Nervesa Della Battaglia (Treviso) (IT)

( * ) Notice: Subject to any disclaimer, the term of this patent is extended or adjusted under 35 U.S.C. 154(b) by 651 days.

(21) Appl. No.: 11/238,401

(22) Filed: Sep. 29, 2005

(65) Prior Publication Data

US 2006/0019000 A1 Jan. 26, 2006

Related U.S. Application Data

(63) Continuation of application No. PCT/EP03/012338, filed on Nov. 5, 2003.

(30) Foreign Application Priority Data

Apr. 2, 2003 (IT) ..... TV2003A0058

(51) Int. Cl.
*B65D 85/00* (2006.01)
*A47J 31/10* (2006.01)

(52) U.S. Cl. ..... 99/295; 426/594; 426/595; 426/77; 426/112; 99/323

(58) Field of Classification Search ..... None
See application file for complete search history.

(56) References Cited

U.S. PATENT DOCUMENTS

| | | | | |
|---|---|---|---|---|
| 4,471,689 | A * | 9/1984 | Piana | 99/295 |
| 5,287,797 | A | 2/1994 | Grykiewicz et al. | |
| 5,637,335 | A * | 6/1997 | Fond et al. | 426/84 |
| 5,897,899 | A * | 4/1999 | Fond | 426/112 |
| 2003/0056661 | A1 * | 3/2003 | Hu et al. | 99/495 |

FOREIGN PATENT DOCUMENTS

| | | |
|---|---|---|
| EP | 0 468 079 | 1/1992 |
| EP | 0 512 148 | 11/1992 |
| EP | 0 521 510 | 1/1993 |
| WO | WO 03/082065 | 10/2003 |

OTHER PUBLICATIONS

International Search Report dated Jun. 3, 2004.
International Preliminary Examination dated Jan. 1, 2005.

* cited by examiner

*Primary Examiner*—Jennifer McNeil
*Assistant Examiner*—Hong Mehta
(74) *Attorney, Agent, or Firm*—Katten Muchin Rosenman LLP

(57) ABSTRACT

Single-dose capsule comprising a sealed moulded-plastic casing (10) having an end wall (16) provided with orifices (24) and a bottom sealing foil (17). A chamber (30) is formed between the said foil (17) and the bottom surface (18) of the perforated end wall (16) and is filled with the beverage percolated through the said orifices (24) before it is discharged directly towards an underlying container through the spout created at the moment of opening or tearing of the said bottom foil (17), immediately before the start of percolation.
USE: preparation of a percolated of the beverage.
ADVANTAGES: high quality of the beverage.

20 Claims, 2 Drawing Sheets

SINGLE-DOSE PLASTIC CAPSULE FOR POWDERED COFFEE AND THE LIKE

CROSS REFERENCE TO RELATED APPLICATION

This application is a continuation of International Application PCT/EP03/012338 which was filed on Nov. 5, 2003, now PCT Publication No. WO 2004/087529 and claims priority from Italian Patent Application No. TV2003A000058 filed Apr. 2, 2003, the contents of which are herein wholly incorporated by reference.

BACKGROUND OF THE INVENTION

1. Field of the Invention

The present invention relates to a single-dose capsule made of moulded plastic and intended for coffee and other alimentary raw materials which are used for the preparation of beverages by means of percolation.

2. Description of the Related Art

A capsule consists essentially of a casing with a frustoconical shape which is filled with coffee powder (or other powdery raw material) and has a peripheral edge onto which a sealing foil is applied. Said foil, at the time of use of the capsule in a professional and/or domestic machine for the preparation of espresso coffee and/or other hot beverages, is directed downwards, namely on the opposite side to the point of entry of the hot water under pressure into the capsule.

As a typical example of the state of the art, the Applicant cites the European patent EP-A-0 521 510 where it is envisaged forming, with the said foil, the flat bottom of the capsule and creating zones of reduced thickness so as to favour tearing of the foil at the time of preparation of the beverage, under the pressure of the water which passes through the powdery raw material in a vertical direction of flow.

The resultant percolated beverage is conveyed along inaccessible pipes inside the coffee machine and then dispensed.

SUMMARY OF THE INVENTION

The use of conventional capsules—owing to their particular constructional design—has the drawback that, since it is not possible to ensure the absolute cleanliness of the said internal pipes, there is the risk of fermentation or putrefaction of the fatty substances contained in the beverage (in particular in coffee). The least negative consequence is an undesirable alteration of the taste of the beverage.

Moreover, it is more difficult, compared to the use of loose coffee powder, to obtain the emulsification of the fatty substances in the coffee—namely the creamy coffee texture which, makes Italian-style espresso coffee so popular worldwide—precisely owing to the presence of said pipes.

Other documents representing the state of art are EP-A-468 079, EP-A-5 12 148 and U.S. Pat. No. 5,287,797.

The object of the present invention is to provide a moulded-plastic capsule intended for coffee and other raw materials for the preparation of beverages by means of percolation, which does not have the abovementioned drawback and which allows high-quality beverages to be obtained.

BRIEF DESCRIPTION OF THE DRAWINGS

These and other objects are achieved by providing a capsule having the characteristic features of the appended claims, as will be clarified by the following description of a non-exclusive embodiment with reference to the accompanying drawing in which:

DETAILED DESCRIPTION OF THE INVENTION

A capsule according to the invention consists of a casing 10 with a slightly frustoconical shape which is made by thermoforming a sheet of polypropylene for alimentary use. The casing 10 has a continuous upper peripheral edge 12 projecting outwards and a bottom non-projecting edge 14. The upper edge 12 is designed to be sealed with a foil 13 of plastic material and/or aluminium. A foil of this kind, as well as its function in single-dose containers of alimentary products, is well known per se to persons skilled in the art, so that it is not considered necessary to describe it in further detail.

Figure 4:
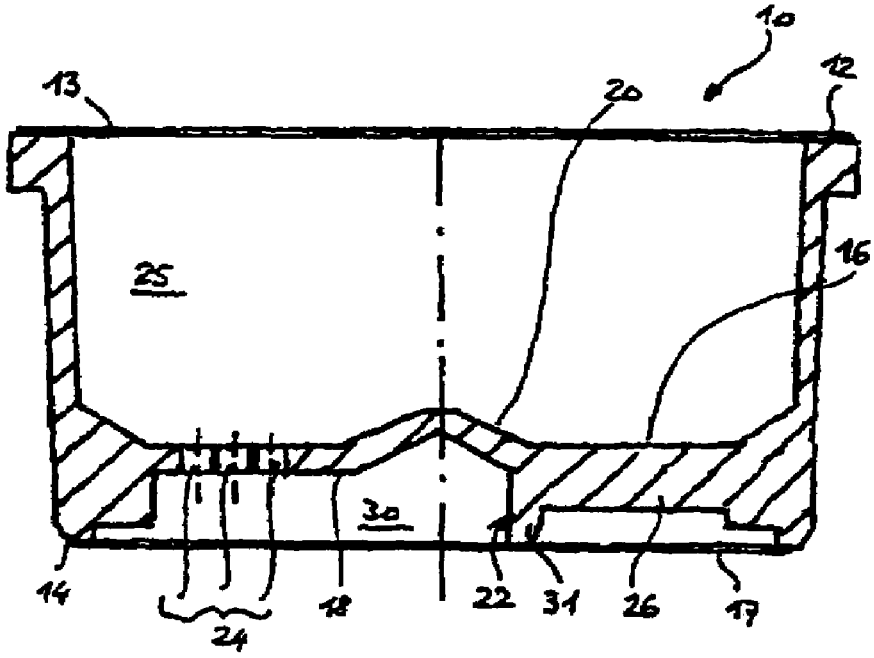
FIG. 4 is a cross-section through the said capsule along line A-A in FIG. 3.

According to a characteristic feature of the invention, the end wall 16 of the casing 10 is inset with respect to the bottom edge 14; basically, as shown in detail in FIG. 4, there exist at least two steps between the edge 14 and the outer surface 18 of the end wall 16. In this way, underneath the upper chamber 25, which contains the powdery raw material, a bottom chamber 30 is formed, said chamber being able to receive and convey the percolated beverage, as explained more fully below, and being closed by a second foil 17. This second foil is preferably formed by a triple layer of film combined with aluminium so as to ensure that the capsule is impermeable and hygienic, it not being considered necessary to describe said foil in greater detail for the same reasons given above in connection with the foil 13.

Figure 1:
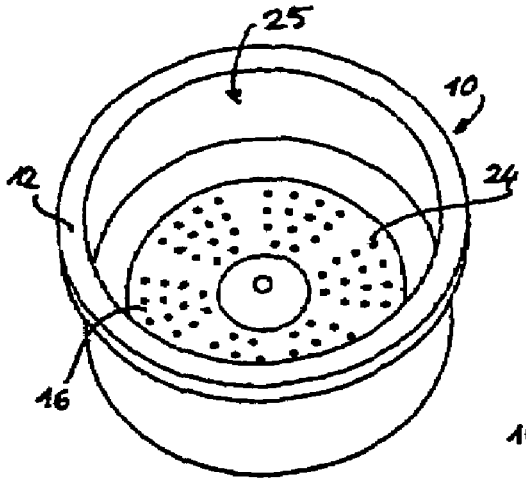
FIG. 1 is a three-dimensional view, from above, of an open capsule according to the invention.
Figure 2:
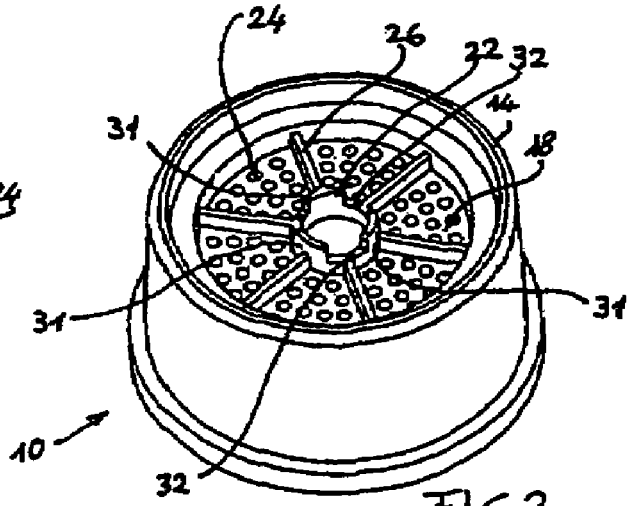
FIG. 2 is a three-dimensional view from below.
Figure 3:
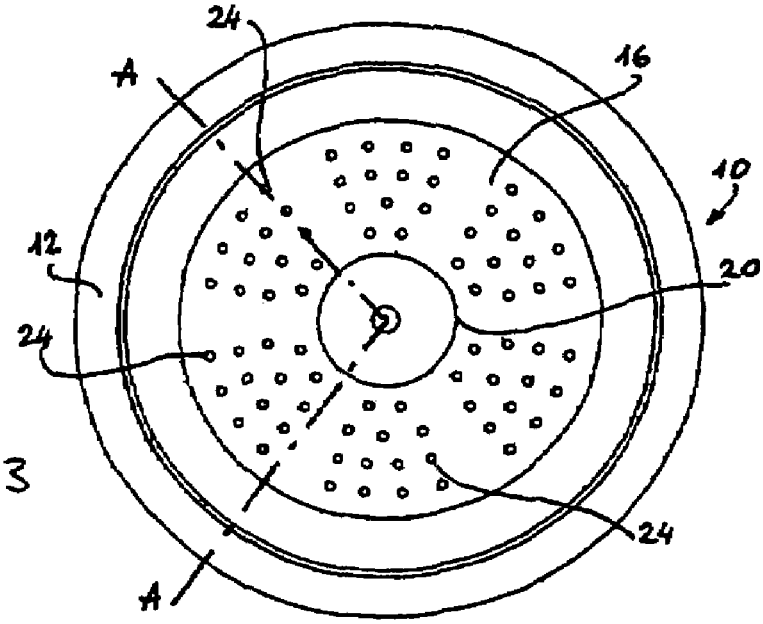
FIG. 3 is a plan view from above.

According to another characteristic feature of the invention, the end wall 16 of the casing 10 has, around a central core having an upper portion in the shape of conical cusp 20 and a substantially cylindrical lower portion 22, consisting of several longer cylindrical segments 31 separated from one another by shorter cylindrical segments 32 (see FIG. 2), a plurality of orifices 24 which are distributed in segments separated by radial ribs 26 (see FIGS. 2 and 4).

The present capsule is used in a machine equipped with punching or drilling means able to create in the upper foil 13 a path (not shown) for the incoming pressurized hot water and a spout (also not shown) directly in the second foil 17, immediately before the start of the percolation of the beverage through the orifices 24. Owing to the combined effect of the pressurized hot water fed from above into the capsule and the shape of the end wall 16, in particular the radial ribs 26, the beverage fills the abovementioned bottom chamber 30 with a turbulent movement which favours emulsification of the fatty substances. In this way, for example an Italian-style creamy coffee of excellent quality is obtained.

Moreover, the beverage is dispensed—through the spout created in the second foil 17—directly into an underlying cup or glass, without being conveyed through the traditional pipes inside the machine and consequently without the risks mentioned 15 hereinabove.

Although the description provided hereinabove relates to a preferred embodiment, it is understood that the invention may be developed with different forms and variants which are included within the following claims.

The invention claimed is:

1. Single-dose capsule for the preparation of a percolated beverage using a powdery raw material, the capsule comprising:

a casing having an upper edge and a bottom edge;

an upper sealing foil and a bottom sealing foil attached to the respective edges;

a lower end wall provided with orifices and inset with respect to said bottom edge;

an upper chamber filled with the raw material which is formed between said upper sealing foil and said end wall, said end wall comprising a central core with an upper portion and a plurality of radial ribs directed downwards around said central core for the separation in segments of said orifices, a bottom chamber underneath said upper chamber and formed between said bottom sealing foil and said end wall, the orifices passing the percolated beverage from the upper chamber to the bottom chamber with a turbulent movement prior to being dispensed towards an underlying container through an exit created in the perforable bottom foil.

2. Single-dose capsule for the preparation of a percolated beverage according to claim 1, wherein said central core of the end wall of the capsule has an upper portion in the shape of a conical cusp and a lower portion substantially cylindrical.

3. Single-dose capsule for the preparation of a percolated beverage according to claim 2, wherein said substantially cylindrical lower portion of the lower wall of the capsule consists of several longer cylindrical segments separated from one another by shorter cylindrical segments.

4. Single-dose capsule for the preparation of a percolated beverage according to claim 1, wherein said bottom sealing foil consists of a triple layer of film combined with aluminum.

5. Single-dose capsule for the preparation of a percolated beverage according to claim 1, wherein the casing has a slightly frustoconical shape and is made preferably by means of thermoforming with a polypropylene grade compatible with foodstuff.

6. Single-dose capsule for the preparation of a percolated beverage according to claim 1, wherein the upper edge of the casing is continuous and projecting outwards.

7. Single-dose capsule for the preparation of a percolated beverage according to claim 1, wherein the bottom edge of the casing is non-projecting.

8. A single-dose capsule for percolating a powdery raw material, the capsule comprising:

a casing having an upper edge and a bottom edge;

a transverse wall disposed between the upper edge and the bottom edge and defining respective upper and lower chambers, a raised cusp formed in the transverse wall and projecting into the upper chamber;

a plurality of radial ribs formed in the transverse wall and projecting into the lower chamber to form a turbulent mixing area between at least two circumferentially adjacent ribs;

a plurality of orifices disposed in the transverse wall and located between the at least two circumferentially adjacent ribs for forming a fluid passage between the upper chamber and the turbulent mixing area.

9. The single-dose capsule of claim 8 further comprising at least one sealing foil disposed at the bottom edge.

10. The single-dose capsule of claim 9, wherein the sealing foil comprises a triple layer of film combined with aluminum.

11. The single-dose capsule of claim 8 further comprising a first sealing foil disposed at the upper edge and a second sealing foil disposed at the bottom edge.

12. The single-dose capsule of claim 8, wherein the plurality of ribs comprise a crenellated circumferential structure for increasing turbulence.

13. The single-dose capsule of claim 8, wherein at least one of the plurality of ribs comprises a crenellated radial structure for increasing turbulence.

14. The single-dose capsule of claim 8, wherein the casing comprises a frustoconical shape.

15. The single-dose capsule of claim 8 further comprising polypropylene grade plastic suitable for foodstuff.

16. The single-dose capsule of claim 8, wherein the upper edge of the casing is continuous and projecting outwards.

17. A single-dose capsule for percolating a powdery raw material, the capsule comprising:

a casing having an upper edge and a bottom edge;

a transverse wall distal from each of the upper edge and the bottom edge and defining respective upper and lower chambers;

a plurality of orifices for fluid passage between the upper and bottom chamber, the plurality of orifices being disposed in the transverse wall;

a plurality of radial projections formed in the wall and projecting into the bottom chamber to effect a turbulent zone.

18. The single-dose capsule of claim 17 further comprising a raised cusp formed in the wall and projecting into the upper chamber.

19. The single-dose capsule of claim 18 further comprising at least one sealing foil disposed at the bottom edge.

20. The single-dose capsule of claim 18 further comprising a first sealing foil disposed at the upper edge and a second sealing foil disposed at the bottom edge.

* * * * *